US010344222B2

(12) United States Patent
Agrawal et al.

(10) Patent No.: US 10,344,222 B2
(45) Date of Patent: Jul. 9, 2019

(54) UPGRADING HYDROCARBON PYROLYSIS PRODUCTS

(71) Applicant: ExxonMobil Chemical Patents Inc., Baytown, TX (US)

(72) Inventors: Gaurav Agrawal, Raritan, NJ (US); Stephen T. Cohn, Spring, TX (US); Kapil Kandel, Humble, TX (US); Subramanya V. Nayak, Atascocita, TX (US); Teng Xu, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 15/971,590

(22) Filed: May 4, 2018

(65) Prior Publication Data

US 2018/0334622 A1 Nov. 22, 2018

Related U.S. Application Data

(60) Provisional application No. 62/507,435, filed on May 17, 2017.

(51) Int. Cl.

| | |
|---|---|
| ***C10G 9/36*** | (2006.01) |
| ***C10G 47/04*** | (2006.01) |
| ***C10G 45/38*** | (2006.01) |
| ***C10G 47/00*** | (2006.01) |
| ***C10G 65/04*** | (2006.01) |
| ***C10G 65/12*** | (2006.01) |

(52) U.S. Cl.

CPC ..... *C10G 47/04* (2013.01); *C10G 9/36* (2013.01); *C10G 45/38* (2013.01); *C10G 47/00* (2013.01); *C10G 65/04* (2013.01); *C10G 65/12* (2013.01); *C10G 2300/301* (2013.01); *C10G 2400/04* (2013.01)

(58) Field of Classification Search

CPC ..... C10G 51/023; C10G 55/04; C10G 2300/202; C10G 69/06; C10G 2400/20; C10G 2400/30; C10G 2400/04; C10G 2300/301; C10G 9/36; C10G 47/00; C10G 67/02; C10G 2400/02; C10G 7/06; C10G 45/00; C10G 21/00; C10G 2300/1048; C10G 2400/08; C07C 2/22; C07C 11/02; C07C 29/04; C07C 4/04; C07C 29/03; C07C 29/88; C07C 2/12; C07C 2/24; C07C 2/66; C07C 317/08; C07C 31/12; C07C 37/70; C07C 41/44; C07C 45/85; C07C 4/025; C07C 4/06; C07C 5/03; C07C 5/13; C07C 69/02; C07C 69/533

See application file for complete search history.

(56) References Cited

U.S. PATENT DOCUMENTS

| | | | | |
|---|---|---|---|---|
| 8,083,931 | B2 | 12/2011 | McCoy et al. | |
| 2011/0042269 | A1 | 2/2011 | Kuechler et al. | |
| 2012/0318712 | A1 | 12/2012 | Vannauker et al. | |
| 2014/0061096 | A1* | 3/2014 | Brown ..... | C10G 69/06 208/73 |
| 2014/0061100 | A1 | 3/2014 | Lattner et al. | |
| 2016/0177205 | A1 | 6/2016 | Evans et al. | |

FOREIGN PATENT DOCUMENTS

| | | | |
|---|---|---|---|
| WO | 02/26917 | A | 4/2002 |
| WO | 2013/033580 | A | 3/2013 |
| WO | 2013/033590 | A | 3/2013 |
| WO | 2013/135973 | A | 9/2013 |

* cited by examiner

*Primary Examiner* — Sharon Pregler

(57) ABSTRACT

A hydrocarbon conversion process comprises providing a hydrocarbon feedstock comprising an effluent fraction from a pyrolysis process, wherein the effluent fraction has an initial boiling point at atmospheric pressure of at least 177° C. and a final boiling point at atmospheric pressure of no more than 343° C. and comprises at least 0.5 wt. % of olefinic hydrogen atoms based on the total weight of hydrogen atoms in the effluent fraction. The hydrocarbon feedstock is hydroprocessed in at least one hydroprocessing zone in the presence of treatment gas comprising molecular hydrogen under catalytic hydroprocessing conditions to produce a hydroprocessed product comprising less than 0.5 wt. % of olefinic hydrogen atoms based on the total weight of hydrogen atoms in the hydroprocessed product. The hydroprocessing conditions comprise a temperature from 150 to 350° C. and a pressure from 500 to 1500 psig (3550 to 10445 kPa-a).

20 Claims, No Drawings

UPGRADING HYDROCARBON PYROLYSIS PRODUCTS

CROSS-REFERENCE OF RELATED APPLICATIONS

This application claims the benefit of Provisional Application No. 62/507,435, filed May 17, 2017, the disclosure of which is incorporated herein by reference.

FIELD

This invention relates to a process for upgrading hydrocarbon pyrolysis products, particularly steam cracked gas oil, to the resulting upgraded pyrolysis product, and to use of the upgraded pyrolysis product.

BACKGROUND

Pyrolysis processes, such as steam cracking, are widely utilized for converting saturated hydrocarbons to higher-value products such as light olefins, e.g., ethylene, propylene and butenes. Conventional steam cracking utilizes a pyrolysis furnace that has two main sections: a convection section, and a radiant section. In the conventional pyrolysis furnace, the hydrocarbon feedstock enters the convection section of the furnace as a liquid (except for light feed stocks which enter as a vapor) wherein it is heated and vaporized by indirect contact with hot flue gas from the radiant section and optionally by direct contact with steam. The vaporized feedstock and steam mixture (if present) are then introduced through crossover piping into the radiant section where the cracking takes place. The resulting products comprising olefins leave the pyrolysis furnace for further downstream processing.

Although pyrolysis principally involves heating the hydrocarbon feedstock sufficiently to cause thermal decomposition of the larger molecules, the process also produces molecules that tend to combine to form high molecular weight materials, the heaviest of which are steam cracked gas oil ("SCGO") and steam cracked tar ("SCT"). Not only are SCGO and SCT among the least valuable products obtained from the effluent of a pyrolysis furnace, feedstocks containing higher boiling materials ("heavy feeds") generally tend to produce greater quantities of SCGO and SCT. Thus, as the refining industry is required to process more heavy feeds, there is a growing need to upgrade these heavy pyrolysis products.

For example, SCGO is a highly aromatic, hydrocarbon fraction boiling in the range 350 to 650° F. (177 to 343° C.), normally 400 to 550° F.(204 to 288° C.), and composed mainly of $C_{10}$ to $C_{17}$ hydrocarbons. The combination of its high aromaticity and its desirable boiling point distribution make SCGO a potentially attractive solvent, especially in the upgrading of SCT. However, SCGO typically has a high olefin content, with 3.0 wt % of the hydrogen atoms being olefinic, as measured by $^1H$ NMR peak integration. In addition, SCGO typically has a high sulfur content, generally in excess of 0.5% by weight. Both of these properties currently prevent SCGO from being a high value product. Olefins are unstable and have a tendency to polymerize at higher temperatures. This prevents the use of SCGO as a solvent for SCT hydroprocessing due to increased problems with reactor fouling. In addition, its high sulfur content effectively prevents SCGO from being used as an additive for fuels.

There is therefore a need for a simple and effective method of upgrading SCGO by decreasing its olefin content and/or its sulfur content.

SUMMARY

The invention is based in part on the discovery that pyrolysis gas oil, such as SCGO, can be upgraded to remove sulfur and decrease olefin content, but without undue saturation of aromatic hydrocarbon.

Accordingly, certain aspects of the invention reside in a hydrocarbon conversion process comprising:

(a) providing a hydrocarbon feedstock comprising an effluent fraction from a pyrolysis process, wherein the effluent fraction has an initial boiling point at atmospheric pressure of at least 177° C. and a final boiling point at atmospheric pressure of no more than 343° C. and comprises at least 0.5 wt. % of olefinic hydrogen atoms based on the total weight of hydrogen atoms in the effluent fraction; and (b) hydroprocessing the hydrocarbon feedstock in at least one hydroprocessing zone in the presence of treatment gas comprising molecular hydrogen under catalytic hydroprocessing conditions to produce a hydroprocessed product comprising less than 0.5 wt. % of olefinic hydrogen atoms based on the total weight of hydrogen atoms in the hydroprocessed product, wherein the hydroprocessing conditions comprise a temperature from 150 to 350° C. and a pressure from 500 to 1500 psig (3550 to 10445 kPa-a).

In other aspects, the effluent fraction comprises at least 0.5 wt. % of sulfur and the hydroprocessed product comprises less than 0.1 wt. % of sulfur.

The invention also resides in the use of the resultant hydroprocessed product as a diesel fuel additive, in the upgrading of pyrolysis tar and as a source of aromatic hydrocarbons.

DETAILED DESCRIPTION OF THE EMBODIMENTS

Hydrocarbon pyrolysis processes, especially steam cracking, are extensively employed in the chemical industry to generate light olefins, e.g., ethylene, propylene and butenes, from saturated hydrocarbon feedstocks. However, in addition to the desired light olefins, the pyrolysis process also produces molecules that combine under the conditions in the pyrolysis furnace to form higher molecular weight materials. Thus, the typical effluent from a pyrolysis process may contain from 15 to 45 wt. % of $C_{5+}$ hydrocarbons comprising, in ascending order of molecular weight, steam cracked naphtha (SCN), steam cracked gas oil (SCGO) and steam cracker tar (SCT). The present disclosure is directed towards a process for upgrading the steam cracked gas oil (SCGO) fraction from a hydrocarbon pyrolysis process so as to decrease at least the olefin content of the SCGO and preferably to decrease both the olefin and the sulfur contents of the SCGO, and more preferably to do so without appreciable aromatics saturation.

As used herein the term "SCGO" refers to the effluent fraction from a hydrocarbon pyrolysis process that has an initial boiling point at atmospheric pressure of at least 177° C., preferably at least 200° C., and a final boiling point at atmospheric pressure of no more than 343° C. In some embodiments, at least 70 wt. %, such as least 80 wt. % of the effluent fraction in the SCGO employed in the present process has a boiling point at atmospheric pressure of less than 260° C. Additionally, or alternatively, the SCGO employed herein may be composed mainly of $C_{10}$ to $C_{17}$ hydrocarbons and may comprise at least 60 wt. % of one and two ring aromatic compounds.

Aspects of the invention which include producing SCT by steam cracking will now be described in more detail. The invention is not limited to these aspects, and this description is not meant to foreclose other aspects within the broader scope of the invention, such as those which involve pyrolysis in the absence of steam Production of SCGO by Steam Cracking Conventional steam cracking utilizes a pyrolysis furnace which has two main sections: a convection section and a radiant section. The pyrolysis feedstock typically enters the convection section of the furnace where the hydrocarbon component of the pyrolysis feedstock is heated and vaporized by indirect contact with hot flue gas from the radiant section and by direct contact with the steam component of the pyrolysis feedstock. The vaporized hydrocarbon component is then introduced into the radiant section where ≥50% (weight basis) of the cracking takes place. A pyrolysis effluent is conducted away from the pyrolysis furnace, the pyrolysis effluent comprising products resulting from the pyrolysis of the pyrolysis feedstock and any unconverted components of the pyrolysis feedstock. At least one separation stage is generally located downstream of the pyrolysis furnace, the separation stage being utilized for separating from the pyrolysis effluent one or more of light olefins, SCN, SCGO, SCT, water, unreacted hydrocarbon components of the pyrolysis feedstock, etc. The separation stage can comprise, e.g., a primary fractionator. Generally, a cooling stage is located between the pyrolysis furnace and the separation stage. Conventional cooling means can be utilized by the cooling stage, e.g., one or more of direct quench and/or indirect heat exchange, but the invention is not limited thereto.

The pyrolysis feedstock typically comprises hydrocarbon and steam. In certain aspects, the pyrolysis feedstock comprises ≥10.0 wt. % hydrocarbon, e.g., ≥25.0 wt. %, ≥50.0 wt. %, such as ≥65 wt. % hydrocarbon, based on the weight of the pyrolysis feedstock. Although the pyrolysis feedstock's hydrocarbon can comprise one or more light hydrocarbons such as methane, ethane, propane, butane, etc., it can be particularly advantageous to utilize a pyrolysis feedstock comprising a significant amount of higher molecular weight hydrocarbons because the pyrolysis of these molecules generally results in more SCGO than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain embodiments, the hydrocarbon component of the pyrolysis feedstock comprises ≥5 wt. % of non-volatile components, e.g., ≥30 wt. %, such as ≥40 wt. %, or in the range of 5 wt. % to 50 wt. %, based on the weight of the hydrocarbon component. Non-volatile components are the fraction of the hydrocarbon feed with a nominal boiling point above 1100° F. (590° C.) as measured by ASTM D-6352-98, D-7580. These ASTM methods can be extrapolated, e.g., when a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon component of the pyrolysis feedstock can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 wt. % of a particular sample has reached its boiling point.

In certain aspects, the hydrocarbon component of the pyrolysis feedstock comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the hydrocarbon component of the pyrolysis feedstock comprises sulfur, e.g., ≥0.1 wt. % sulfur, e.g., ≥1.0 wt. %, such as in the range of about 1.0 wt. % to about 5.0 wt. %, based on the weight of the hydrocarbon component of the pyrolysis feedstock. Optionally, at least a portion of the pyrolysis feedstock's sulfur-containing molecules, e.g., ≥10.0 wt. % of the pyrolysis feedstock's sulfur-containing molecules, contain at least one aromatic ring ("aromatic sulfur"). When (i) the pyrolysis feedstock's hydrocarbon is a crude oil or crude oil fraction comprising ≥0.1 wt. % of aromatic sulfur, and (ii) the pyrolysis is steam cracking, then the SCGO contains a significant amount of sulfur derived from the pyrolysis feedstock's aromatic sulfur. For example, the SCGO sulfur content can be about 3 to 4 times higher than in the pyrolysis feedstock's hydrocarbon component, on a weight basis.

In certain embodiments, the pyrolysis feedstock comprises steam in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the pyrolysis feedstock comprises hydrocarbon and diluent, wherein:

a. the pyrolysis feedstock's hydrocarbon comprises ≥50.0 wt. % based on the weight of the pyrolysis feedstock's hydrocarbon of one or more crude oils and/or one or more crude oil fractions, such as those obtained from an APS and/or VPS; waxy residues; atmospheric residues; naphthas contaminated with crude; various residue admixtures; and SCT; and
b. the pyrolysis feedstock's diluent comprises, e.g., ≥95.0 wt. % water based on the weight of the diluent, wherein the amount of diluent in the pyrolysis feedstock is in the range of from about 10.0 wt. % to 90.0 wt. %, based on the weight of the pyrolysis feedstock.

In these aspects, the steam cracking conditions generally include one or more of (i) a temperature in the range of 760° C. to 880° C., (ii) a pressure in the range of from 1.0 to 5.0 bar (absolute), or (iii) a cracking residence time in the range of from 0.10 to 2.0 seconds.

The effluent from the steam cracking process is conducted away from the pyrolysis furnace to a cooling and separation system to recover the various components of the effluent, including SCGO. For example, the pyrolysis effluent can be cooled to a temperature in the range of about 700° C. to 350° C. using a system comprising transfer line heat exchangers, in order to efficiently generate super-high pressure steam which can be utilized by the process or conducted away. If desired, the pyrolysis effluent can be subjected to direct quench at a point typically between the furnace outlet and the separation stage. The quench can be accomplished by contacting the pyrolysis effluent with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench fluids include liquid quench oil, such as those obtained by a downstream quench oil knock-out drum, pyrolysis fuel oil and water, which can be obtained from conventional sources, e.g., condensed dilution steam.

A separation stage can be utilized downstream of the pyrolysis furnace and downstream of the transfer line exchanger and/or quench point for separating from the pyrolysis effluent one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931.

The utility of the SCGO produced by the pyrolysis process described above is limited by its inherently high olefin content. The olefin content of a hydrocarbon sample can be measured in a number of ways. One method involves NMR and in particular the integration of the area under the peaks in the olefinic region of the NMR spectrum of the sample. The olefinic region of the $^{1}H$ NMR spectrum is indicated by the presence of olefinic hydrogen atoms, i.e., hydrogen atoms attached to a carbon atom that shares a double bond with an adjacent carbon atom. In the case of such a measurement method, SCGO generally comprises at least 0.5 wt. %, such at least 1 wt. %, such at least 1.5 wt. %, such at least 2 wt. %, such at least 2.5 wt. %, often at least 3 wt. % of olefinic hydrogen atoms based on the total weight of hydrogen atoms in the SCGO sample. Another method of measuring olefin content is Bromine Number, which is the amount of bromine in grams absorbed by 100 grams of a sample. Bromine Number is usually determined by electrochemical titration, according to ASTM D1492. However, such titration is also affected by aromatics content and is therefore not a very accurate measure of olefins in SCGO. Typical SCGO products have a Bromine Number of at least 10, such as at least 15, for example at least 20.

Use of the SCGO, particularly as a fuel, is further restricted by its high sulfur content. Thus, most SCGO products contain at least 0.5 wt. %, such at least 0.75 wt. %, sulfur whereas the maximum sulfur content to allow hydrocarbon products to be used as Emission Control Area (ECA) fuels is 0.1 wt. %.

Certain aspects of the invention address these limitations by providing a hydrotreating process for upgrading SCGO so as to decrease at least the olefin content of the SCGO and preferably to decrease both the olefin and the sulfur contents of the SCGO, and more preferably to do so without undue aromatics saturation.

SCGO Hydroprocessing

In the present process, hydroprocessing of the SCGO separated from a pyrolysis process effluent, with or more preferably without any pretreatment, is accomplished by contacting the SCGO with a treatment gas comprising molecular hydrogen in the presence of a hydroprocessing catalyst in at least one hydroprocessing zone.

Suitable hydroprocessing catalysts include those comprising (i) one or more bulk metals, and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst can contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt. % of one or more metals selected from Groups 6, 8, 9, and 10 of the Periodic Table, and (ii) ≥1.0 wt. % of an inorganic oxide, the weight percents being based on the weight of the catalyst.

In one or more embodiments, the catalyst is a bulk multimetallic hydroprocessing catalyst with or without binder. In an embodiment the catalyst comprises at least one Group 8 metal, preferably Ni and/or Co, and at least one Group 6 metal, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, and the support comprises at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source.

The hydroprocessing is carried out in the presence of hydrogen, e.g., by (i) combining molecular hydrogen with the SCGO feed upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Optionally, the amount of molecular hydrogen supplied to the hydroprocessing stage is in the range of from about 500 SCF/B (standard cubic feet per barrel) (89 S $m^3/m^3$) to 10000 SCF/B (1780 S $m^3/m^3$), in which B refers to barrel of SCGO feed to the hydroprocessing stage. For example, the molecular hydrogen can be provided in a range of from 500 SCF/B (89 S $m^3/m^3$) to 3000 SCF/B (534 S $m^3/m^3$).

The hydroprocessing is carried out under hydroprocessing conditions including a temperature from 150 to 350° C. and a pressure from 500 to 1500 psig (3550 to 10445 kPa-a). The preferred temperature within the specified range may vary depending on the particular impurity mainly targeted by the hydroprocessing. Thus, where olefin removal is the main object of the hydroprocessing, lower temperatures, for example from 150 to 250° C., may be preferred. Alternatively, where both olefin and sulfur removal are required, for example to reduce the sulfur level below 0.1 wt. %, higher temperatures, for example from 250 to 350° C., may be preferred.

In some embodiments, the hydroprocessing may be conducted in at least two stages comprising a first stage at a first temperature, for example from 150 to 250° C., and then a second stage at a second, higher temperature, for example from 250 to 350° C.

The hydroprocessing conditions also generally comprise a weight hourly space velocity of the hydrocarbon feedstock of from 0.5 to 3 $hr^{-1}$, such as from 1 to 2 $hr^{-1}$.

Generally, the hydroprocessing conditions are controlled such that the molecular hydrogen consumption rate is in the range of about 200 to 2000 SCF per barrel of the hydrocarbon feedstock or about 36 standard cubic meters/cubic meter (S $m^3/m^3$) to about 356 S $m^3/m^3$, for example in the range of about 300 to about 1500 SCF per barrel of the hydrocarbon feedstock or about 53 standard cubic meters/cubic meter (S $m^3/m^3$) to about 267 S $m^3/m^3$. Doing so has been found to prevent appreciable aromatics saturation, which would otherwise decrease the hydroprocessed gas oil's effectiveness as an aromatic solvent or chemical precursor.

Depending on the conditions used in the hydroprocessing step(s), the olefinic hydrogen atom content of SCGO as measured by $^1H$ NMR can be decreased by the hydroprocessing method described herein from 0.5 wt. % or greater, such as greater than 1 wt. %, to less than 0.5 wt. %, such as less than 0.1 wt. %, even to 0.01 wt. % or less. In terms of Bromine Number, the Bromine Number of SCGO can be decreased by the hydroprocessing method described herein from 10 or greater to less than 10, such as less than 5. In addition, and especially at temperatures of 250° C. and above, the sulfur content of SCGO can be reduced from 0.5 wt. % and above to less than 0.1 wt. %. Typically, appreciable aromatics saturation is avoided, as evidenced by the relatively small change in gas oil density resulting from the hydroprocessing. For example, when space velocity (WHSV) is in the range of from 0.5 $hr^{-1}$ to 3 $hr^{-1}$, the hydroprocessing generally decreases gas oil density (ρ) from an initial value "$\rho_1$" for the gas oil feed to a final value "$\rho_2$" for the hydroprocessed gas oil that is ≤5%

$$\left(\text{as determined by } \frac{\rho_1 - \rho_2}{\rho_1}\right),$$

such as ≤2.5%, or ≤1%, or in the range of 0.05% to 5%, or 1% to 4%.

Uses of Hydroprocessed SCGO

Hydroprocessed SCGO produced by the present process and having an olefinic hydrogen atom content as measured by $^1H$ NMR of less than 0.5 wt. %, such as less than 0.1 wt. %, even to 0.01 wt. % or less is an attractive solvent or utility fluid in the upgrading to the heaviest product of steam cracking, steam cracked tar (SCT). An example of the use of utility fluids in the upgrading of SCT to produce fuel oils and fuel oil blending stocks is described International Publication No. WO 2013/033580.

Hydroprocessed SCGO produced by the present process and having a sulfur content less than 0.1 wt. % is useful as an ECA fuel.

Hydroprocessed SCGO produced by the present process is also a useful precursor for the production, for example by hydrocracking, of aromatic feeds to the chemical industry, such as A200 and benzene, toluene and xylenes (BTX).

The invention will now be more particularly described with reference to the following non-limiting Example.

Example

A systematic study was carried out to explore the influence of space velocity and temperature on the olefins saturation and sulfur reduction in the hydroprocessing of SCGO. The SCGO feed had an average carbon number of 11.04, a total percentage of hydrogen atoms of 8.32%, a density of 0.974 gm/ml and contained 0.92 wt. % sulfur and 2.9 wt. % olefinic hydrogen atoms, as measured by $^1$H NMR peak integration. The hydroprocessing was conducted with a Co/Mo catalyst at a pressure of 1100 psig (7686 kPa-a), a hydrogen feed rate of 3000 scfb hydrogen and at varying temperatures ranging from 150° C. to 300° C. and at weight hourly space velocities of 1 and 2 hr$^{-1}$. The results are shown in Table 1 below.

TABLE 1

| Temp. (° C.) | WHSV | Sulfur Content (wt %) | Olefin H (wt %) | Density (g/mL) | Average Carbon No. | $H_2$ consumption (scfb) | H % |
|---|---|---|---|---|---|---|---|
| 150 | 2 | 0.92 | 0.64 | 0.966 | 11.09 | 224 | 8.70 |
| 175 | 2 | 0.91 | 0.5 | 0.963 | 11.06 | 284 | 8.79 |
| 200 | 2 | 0.81 | 0.1 | 0.96 | 11.03 | 342 | 8.99 |
| 225 | 2 | 0.62 | 0.12 | 0.956 | 11.01 | 405 | 9.10 |
| 250 | 2 | 0.32 | 0.01 | 0.951 | 10.95 | 471 | 9.38 |
| 275 | 2 | 0.1 | — | 0.94 | 10.93 | 637 | 9.38 |
| 300 | 2 | 0.05 | — | 0.935 | 10.92 | 838 | 9.8 |
| 175 | 1 | 0.88 | — | 0.961 | — | 337 | 8.86 |
| 200 | 1 | 0.72 | — | 0.958 | — | 366 | 8.91 |
| 225 | 1 | 0.5 | — | 0.954 | — | 426 | 9.00 |
| 250 | 1 | 0.19 | — | 0.949 | — | 538 | 9.19 |
| 275 | 1 | 0.06 | — | 0.941 | — | 745 | 9.53 |
| 300 | 1 | 0.03 | — | 0.933 | — | 1000 | 9.95 |

As shown in Table 1, the olefin content of the SCGO was reduced by 97% (by H$^1$ NMR) by hydroprocessing at 2 WHSV and 200° C. As further illustrated in Table 1, the sulfur content was reduced to 0.1% or less by hydroprocessing at 275° C., both at 1 and 2 WHSV. Hence, for the feed tested, at 1-2 WHSV a hydroprocessing temperature of at least 275° C. seems to be preferred for upgrading the SCGO product to achieve both olefin and sulfur reduction. For olefin reduction alone, lower temperatures, such as at least 200° C., may be sufficient. As shown in the table, the decrease in sulfur content and the decrease in olefin content can be achieved without undue saturation of aromatic hydrocarbon, as evidenced by the slight decrease in density.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A hydrocarbon conversion process comprising:

(a) providing a hydrocarbon feedstock comprising an effluent fraction from a pyrolysis process, wherein the effluent fraction has an initial boiling point at atmospheric pressure of at least 177° C. and a final boiling point at atmospheric pressure of no more than 343° C. and comprises at least 0.5 wt. % of olefinic hydrogen atoms based on the total weight of hydrogen atoms in the effluent fraction; and (b) hydroprocessing the hydrocarbon feedstock in at least one hydroprocessing zone in the presence of treatment gas comprising molecular hydrogen under catalytic hydroprocessing conditions to produce a hydroprocessed product comprising less than 0.5 wt. % of olefinic hydrogen atoms based on the total weight of hydrogen atoms in the hydroprocessed product, wherein the hydroprocessing conditions comprise a temperature from 150 to 350° C. and a pressure from 500 to 1500 psig.

2. The process of claim 1, wherein the effluent fraction has an initial boiling point at atmospheric pressure of at least 200° C.

3. The process of claim 1, wherein at least 70 wt. % of the effluent fraction has a boiling point at atmospheric pressure less than 260° C.

4. The process of claim 1, wherein the hydroprocessing conditions comprise a weight hourly space velocity of the hydrocarbon feedstock of 0.5 to 3 hr$^{-1}$.

5. The process of claim 1, wherein the hydroprocessing conditions comprise a weight hourly space velocity of the hydrocarbon feedstock of 1 to 2 hr$^{-1}$.

6. The process of claim 1, wherein molecular hydrogen is supplied to the hydroprocessing zone at a rate of 500 to 3000 SCF per barrel of the hydrocarbon feedstock.

7. The process of claim 1, wherein the hydroprocessing (b) is conducted in the presence of a catalyst comprising at least one Group 8 metal and at least one Group 6 metal.

8. The process of claim 1, wherein the hydroprocessing (b) is conducted in at least two stages comprising a first stage at a first temperature and then a second stage at a second, higher temperature.

9. The process of claim 1, wherein the hydroprocessed product comprises less than 0.1 wt. % of olefinic hydrogen atoms based on the total weight of hydrogen atoms in the hydroprocessed product.

10. The process of claim 1, wherein the effluent fraction has a Bromine Number greater than 10 and the hydroprocessed product has a Bromine Number less than 10.

11. The process of claim 10, wherein the hydroprocessed product has a Bromine Number less than 5.

12. The process of claim 1, wherein the hydroprocessing conditions comprise a temperature from 250 to 300° C.

13. The process of claim 12, wherein the effluent fraction comprises at least 0.5 wt. % of sulfur and the hydroprocessed product comprises less than 0.1 wt. % of sulfur.

14. A diesel fuel comprising the hydroprocessed product of claim 13.

15. A process for upgrading pyrolysis tar having an initial boiling point at atmospheric pressure of at least 290° C., the process comprising combining the pyrolysis tar with the hydroprocessed product of claim 1 and contacting the combination of the pyrolysis tar and the hydroprocessed product with a treatment gas comprising molecular hydrogen under catalytic hydroprocessing conditions to produce a hydroprocessed tar.

16. A process for producing aromatic hydrocarbons comprising contacting the hydroprocessed product of claim 1 with a treatment gas comprising molecular hydrogen under catalytic hydrocracking conditions.

17. The process of claim 1, wherein:

the effluent fraction comprises at least 2.5 wt. % of olefinic hydrogen atoms, based on the total weight of hydrogen atoms in the effluent fraction and the hydroprocessed product comprises 0.1 wt. % or less of olefinic hydrogen atoms, based on the total weight of hydrogen atoms in the hydroprocessed product, and the effluent fraction comprises at least 0.75 wt. % of sulfur and the hydroprocessed product comprises less than 0.1 wt. % of sulfur.

18. The process of claim 1, wherein:

the hydroprocessing (b) is conducted in at least two stages comprising a first stage at a first temperature and then a second stage at a second, higher temperature, wherein the effluent is contacted with a first catalyst in the first stage to produce a pre-treated effluent fraction, and wherein the pre-treated effluent fraction is contacted with a second catalyst in the second stage to produce the hydroprocessed product, the effluent fraction comprises at least 2.5 wt. % of olefinic hydrogen atoms, based on the total weight of hydrogen atoms in the effluent fraction and the hydroprocessed product comprises 0.1 wt. % or less of olefinic hydrogen atoms, based on the total weight of hydrogen atoms in the hydroprocessed product, and the effluent fraction comprises at least 0.75 wt. % of sulfur and the hydroprocessed product comprises less than 0.1 wt. % of sulfur.

19. The process of claim 1, wherein:

at least 70 wt. % of the effluent fraction has a boiling point at atmospheric pressure less than 260° C., the hydroprocessing conditions comprise a temperature from 250 to 300° C. and a weight hourly space velocity of the hydrocarbon feedstock of 1 to 2 $hr^{-1}$, the effluent fraction comprises at least 2.5 wt. % of olefinic hydrogen atoms, based on the total weight of hydrogen atoms in the effluent fraction and the hydroprocessed product comprises 0.1 wt. % or less of olefinic hydrogen atoms, based on the total weight of hydrogen atoms in the hydroprocessed product, the effluent fraction comprises at least 0.75 wt. % of sulfur and the hydroprocessed product comprises less than 0.1 wt. % of sulfur, the effluent fraction has a Bromine Number greater than 10 and the hydroprocessed product has a Bromine Number less than 5.

20. The process of claim 1, wherein:

at least 80 wt. % of the effluent fraction has a boiling point at atmospheric pressure less than 260° C., the hydroprocessing (b) is conducted in at least two stages comprising a first stage at a first temperature and then a second stage at a second, higher temperature, wherein the effluent is contacted with a first catalyst in the first stage to produce a pre-treated effluent fraction, wherein the pre-treated effluent fraction is contacted with a second catalyst in the second stage to produce the hydroprocessed product, and wherein at least one of the first catalyst and the second catalyst comprises Mo and at least one of Ni and Co, the hydroprocessing conditions comprise a temperature from 250 to 300° C. and a weight hourly space velocity of the hydrocarbon feedstock of 1 to 2 $hr^{-1}$, the effluent fraction comprises at least 2.5 wt. % of olefinic hydrogen atoms, based on the total weight of hydrogen atoms in the effluent fraction and the hydroprocessed product comprises 0.1 wt. % or less of olefinic hydrogen atoms, based on the total weight of hydrogen atoms in the hydroprocessed product, the effluent fraction comprises at least 0.75 wt. % of sulfur and the hydroprocessed product comprises less than 0.1 wt. % of sulfur, the effluent fraction has a Bromine Number greater than 10 and the hydroprocessed product has a Bromine Number less than 5.

* * * * *